United States Patent [19]

Ako

[11] Patent Number: 4,918,906

[45] Date of Patent: Apr. 24, 1990

[54] METHOD AND APPARATUS FOR PRODUCING A BAG-IN-CARTON

[75] Inventor: Shigeich Ako, New South Wales, Australia

[73] Assignee: Matsushima Engineering Co., Ltd., Nagasaki, Japan

[21] Appl. No.: 169,943

[22] Filed: Mar. 18, 1988

[30] Foreign Application Priority Data

Mar. 20, 1987 [JP] Japan ..... 62-64492
Mar. 20, 1987 [JP] Japan ..... 62-64493

[51] Int. Cl.[5] ..... B65B 43/14; B65B 43/04

[52] U.S. Cl. ..... 53/449; 53/456; 53/175; 53/563; 493/100; 493/179

[58] Field of Search ..... 53/449, 456, 170, 175, 53/563; 493/93, 100, 101, 179, 295

[56] References Cited

U.S. PATENT DOCUMENTS

| | | | |
|---|---|---|---|
| 2,701,990 | 2/1955 | Fergnani | 493/179 X |
| 3,314,210 | 4/1967 | Järund . | |
| 3,395,623 | 8/1968 | Baker | 53/449 |
| 3,577,699 | 5/1971 | Silver | 53/175 X |
| 3,774,509 | 11/1973 | Heinzer . | |
| 3,775,945 | 12/1973 | Kuhnle . | |
| 4,089,255 | 5/1975 | Akoh | 53/175 X |
| 4,089,255 | 5/1978 | Akoh et al. . | |
| 4,280,313 | 7/1981 | Akkala | 53/175 |
| 4,287,703 | 9/1981 | Henle | 53/175 X |
| 4,505,769 | 3/1985 | Auckenthaler | 493/295 X |
| 4,729,209 | 3/1988 | Owensby | 53/175 X |

FOREIGN PATENT DOCUMENTS

| | | | |
|---|---|---|---|
| 842523 | 5/1970 | Canada | 53/563 |

*Primary Examiner*—John Sipos
*Attorney, Agent, or Firm*—Michael J. Striker

[57] ABSTRACT

In a method and a device for producing bags wrapped in a carton, carton blanks are fed to a first conveyor in which a square tubular half-finished carton is produced which is fed to a second conveyor wherein the half-finished carton is formed into a box-like shaped carton, into which a bag made of film in a bag making apparatus is inserted. The bag wrapped with carton is then filled with a product to be packed and sealed.

22 Claims, 16 Drawing Sheets

METHOD AND APPARATUS FOR PRODUCING A BAG-IN-CARTON

BACKGROUND OF THE INVENTION

The present invention relates to a method and apparatus for automatically producing bags wrapped in cartons. Such a bag is a compound container combining inside an outer carton a bag made of plastic film, moisture-proof paper, or stuck-together sheet made of paper or plastic film and a metal foil.

In general, a bag wrapped in carton has often been used in the past as a compound container to be filled up with or to have sealed inside it various solid, powder or liquid products that need airtight packing or moisture-proof packing, for example snack foods such as biscuits and potato chips, detergent and medicine items, etc.

One of the most common methods for making such a bag involves a system that produces a carton with a bag inside it. This system is one in which an intermittently rotating multi-step mandrel is used.

This known method comprises wrapping a sheet of bag material around an intermittently rotating forming block by using an apparatus comprising forming blocks attached to the tip of a multi-step mandrel which can rotate horizontally, sealing the side seam and the bottom portion to form a bag, and bonding the carton material to the bag while wrapping the carton material over it to form an outer carton. In this method, wrapping of the bag material, sealing movements, and wrapping of the carton material have to be conducted when the intermittently rotating mandrel is stopped. Therefore, it has been found that it is difficult to increase the speed at which a bag-in-carton is produced. Also, the intermittent mechanism of the mandrel is prone to breakdown or failure because each portion of the mandrel repeatedly stops and starts moving. Moreover, the carton material and the bag material have to be supplied with mechanically accurate synchronization, which requires the intermittent mechanism to be complex and highly precise. Further, in this method, the bag material may cause such troubles as curling itself up because of static electricity, or difficulty in fitting to the forming block, unless the bag material has appropriate stiffness. Because of these problems, completed products have tended to have a drawback, that is the increased cost of production. Another defect in this known method is that, when the size of the carton material or the bag material is to be changed, it is quite labor-consuming and time-consuming to change and adjust a number of forming blocks attached to the mandrel. Therefore, it has been found that changing the size has been practically extremely difficult.

In another typical method for producing bags of the type under consideration, a bag and a carton housing have been made separately. The bag has been stuffed with the product to be packed, and then this bag has been inserted into the carton. In this method, since the bag is pre-loaded with the product, the bag tends not to be evenly shaped and its middle portion tends to get bigger. Therefore, the contact between the bag and the carton makes it difficult for the bag to be tightly inserted into the carton. This leads to the introduction of a process in which the loaded bag is stroked from both ends to reform the bag. However, the product in the bag can be damaged during this process, and the bag material is required to have appropriate stiffness because the bag is stroked by machine or hand. Also, in order to prevent said trouble and to increase the efficiency of assembling the bag and the carton, it is not possible to use a flat, thin carton. Further, the cross-sectional size of the carton has to be made quite large compared with that of the bag, and the cross-section of the carton has to be similar to a square, which is deficient. Therefore this method of production fails to be suitable for various needs of the market because the aforesaid deficiencies cause the cost to increase and restrict the shape of the carton.

In addition, carton packages used for transporting, storing or selling goods are generally required to have a large printing space available on the front portion thereof for advertising and promoting the goods stored inside the packages. Because of this, most of the carton bags are of a rectangular cross-section and a few of them are square. And, in order to increase the front space on the carton bag packages, its width is often changed but not the depth. Since making of the carton packages is carried out while the carton blanks advance in a column with longer sides of the carton blanks parallel to the direction of the production line of the apparatus for producing such a carton bag, it is impossible to make each carton advancing pitch smaller than the longer side of the carton blank.

Also, in regard to the method of producing a so-called bag-in-carton, U.S. Pat. No. 4,089,255 discloses a method by which a flat bag is put in an open-mouthed carton; vacuum pads reach both sides of the bag and automatically open the mouth of the bag when the carton comes to the stopping position; then air is blown into the bag from an air duct thus preparing the bag to be filled with a product. The problem with this method is that the conveyor has to operate intermittently and that such steps as supplying the bag, opening the mouth of the bag, and blowing air into the bag should be carried out while the conveyor is stopped during the intermittent process. Also, it has been found that the bottom portion of the bag is not fully inflated even when air is blown into the bag, which should be improved.

SUMMARY OF THE INVENTION

The first object of the present invention is to provide a new method of production that solves the above-mentioned problems in the previous methods, and produces a bag-in-carton automatically as well as in a high-speed continuous operation.

Another object of this invention is to provide a carton forming apparatus which is most suited to the above-mentioned production method.

A further object of this invention is to provide a method and apparatus that makes it possible to inflate a flattened bag to a given shape and to insert this bag into a previously formed carton automatically.

These and other objects of the invention are attained by a method of producing a bag-in-carton by successively feeding a flat blank, which is to become an outer carton, to a conveyor line, folding said blank along the folding lines and producing a parallelepiped-shape carton lying on its side while advancing and supporting said blank roughly horizontally, turning said parallelepiped-shaped carton lying on its side to stand upright as well as converting its position so that its side panels run parallel to the carton conveyor line, sealing the bottom portion of the carton while it is advanced, successively feeding a flattened bag, which has its top portion unsealed and is to become a liner bag, to the said conveyor line, and successively inserting the bag into the parallelepiped-shaped carton after inflating said bag to a rectangular parallelepiped shape above the parallelepiped-shaped carton which is being advanced.

The process of producing a square-tubular or parallelepiped-shaped carton from a flat blank may include holding down one of the side panels of the blank with a carton forming block which has a square or rectangular cross-section while continuously advancing said flat blank, successively folding the front and back panels of the blank at right angles by using forming guide rails and forming belts at both sides of the forming block, applying glue to a gluing flap, and bonding the corresponding edge of the blank to the gluing flat after applying glue. Also, the process of forming a flat bag into a parallelepiped shape may include holding the top portion of the bag by applying a pair of holding bars from both sides of the top portion, then holding the bag by suction and opening the mouth of the bag by moving the pair of holding bars apart, and inserting a bag forming mandrel, which has a square or rectangular cross-section, into the bag from above and inflating said bag into a parallelepiped shape, and finally pulling out said forming mandrel upwards from the bag.

The apparatus in this invention may include a carton-transport means by which a carton with its bottom closed is conveyed in a given direction at a regular speed, a bottom guide rail which guides said carton while carrying the bottom of the carton on it, conveyor chains which are driven in synchronism with said transport means, bag supporters which are linked to a chain attachment and positioned on both sides of the mouth of the flattened bag, as well as holding the bag by suction while it can move between the position where they engage the bag and the position where they come off, vacuum pads attached to the bag supporters and connected with a vacuum pump by means of an air hose, means for supporting a bag forming mandrel, which is positioned above the bag supporters so that it can move up and down, a bag forming mandrel which is fixed on the bottom portion of said supporting means and extending vertically in the direction of elongation of the bag and whose size corresponds to that of the bag, at least one air blowing nozzle which is disposed in the bag forming mandrel, a pipe which supplies high-pressure air to the air blowing nozzle, and is adhered to said forming mandrel, and a guiding rail which is disposed on one side of the said forming mandrel and moves said forming mandrel up and down. When the mouth of the bag is opened, the bag forming mandrel is inserted into the bag and inflates the bag to a given shape and inserts the bag into the carton positioned below it.

Then, the bag forming mandrel is easily pulled out of the bag upward because of the air blowing out of the bottom portion of the forming block.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 4:
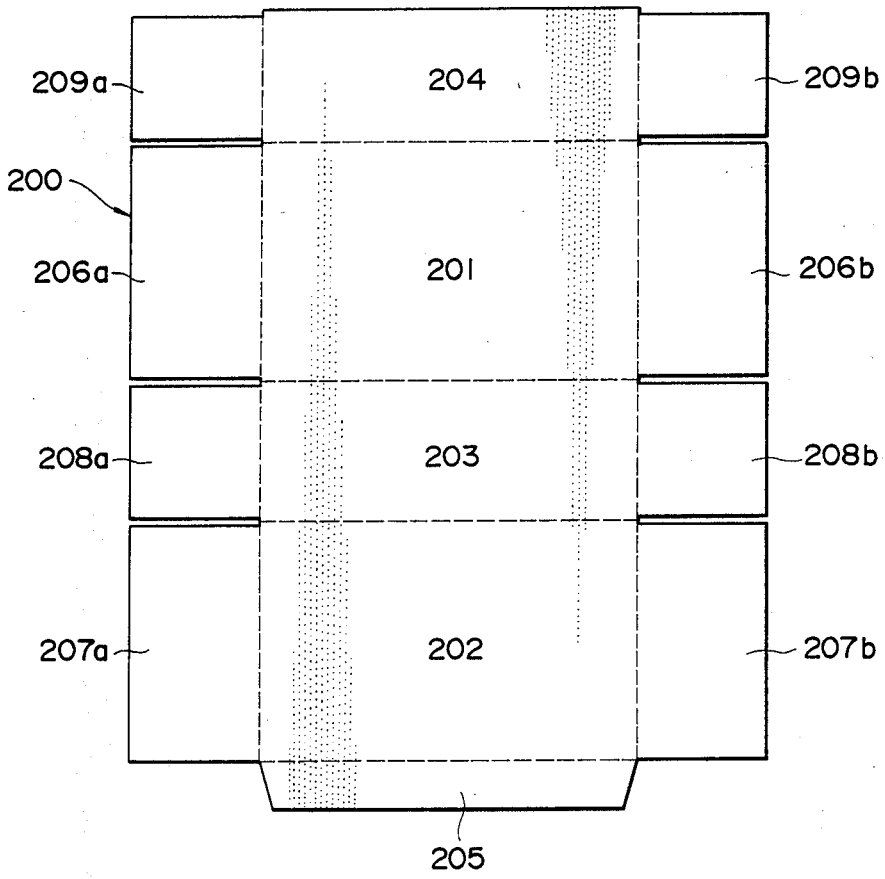
FIG. 4 is a developed view of the flat blank used in this invention.

Referring now to the drawings in detail, first an explanation is given of the developed shape of the carton used in this invention shown in FIG. 4. 200 is a flat blank made of paper board or other suitable sheet material, 201 and 202 are corresponding relatively wide front and rear panels, 203 and 204 are narrow side panels formed continuously with the front and rear panels via folding lines, and 205 is a gluing flap attached to the rear panel 202. Also, **206*a*, 206*b*, 207*a*, 207*b*, 208*a*, 208*b*, 209*a* and 209*b*** are top and bottom inner and outer flaps attached to the top and bottom edges of the front, rear and two side panels, and formed continuously with each other via folding lines.

Figure 1:
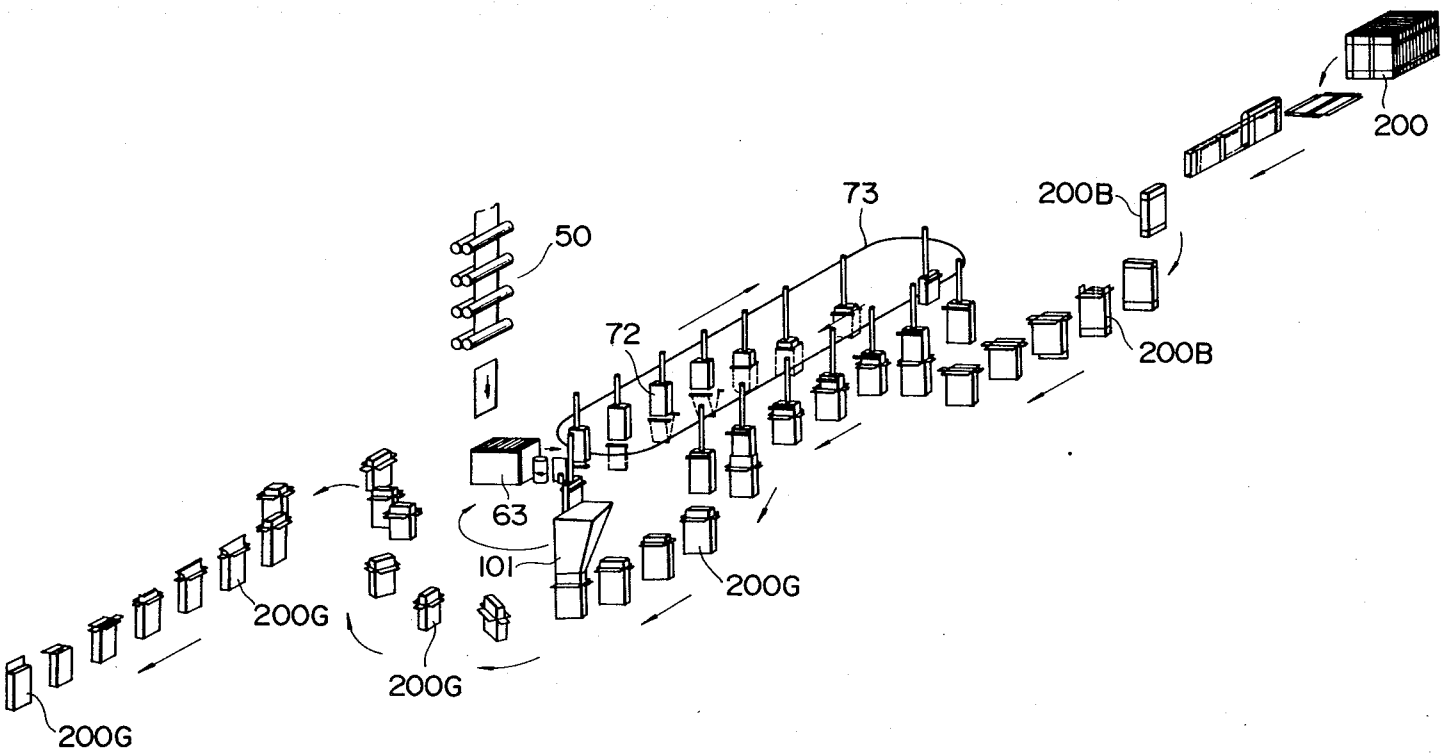
FIG. 1 is a schematic view showing the production process in this invention.
Figure 2:
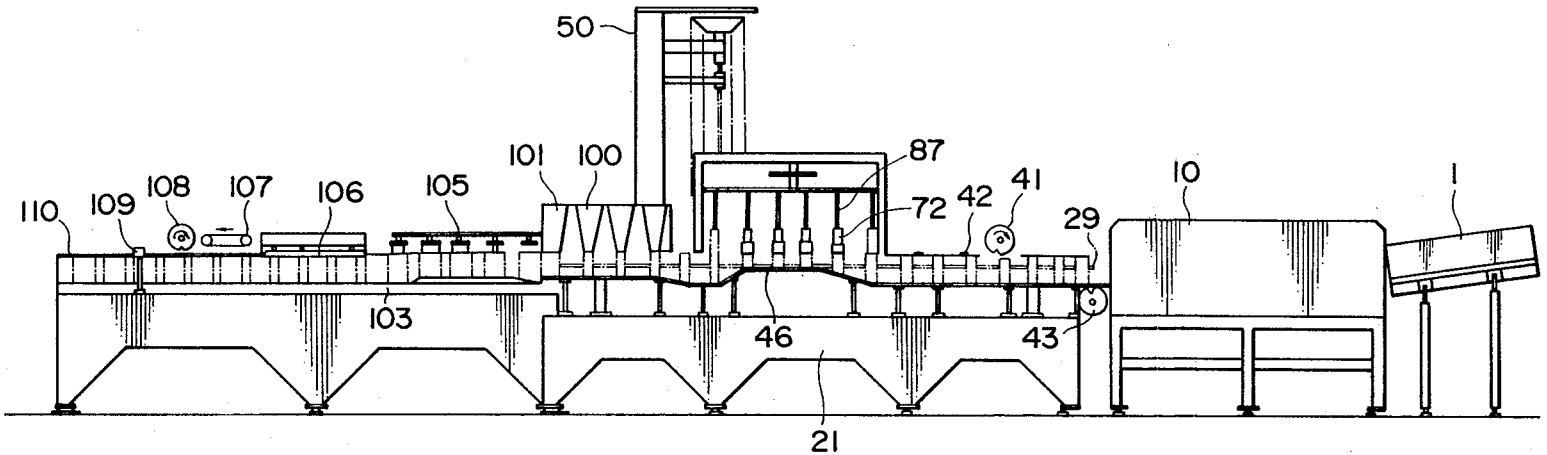
FIG. 2 is a side elevational view of the apparatus for producing bag-in-cartons.

In a method according to the present invention, a carton blank, shown in FIG. 4 and described above is supplied from a carton magazine to be formed into a square-tubular or parallelepiped-shaped carton by a carton former and a carton making machine, as shown in FIGS. 1 and 2. A bag to be placed inside the carton is produced from a flexible film separately. The bag has its mouth opened to be inflated to a parallelepiped shape so that produce can be readily loaded into the bag, while the bag is automatically inserted into the carton which has been composed and formed. Then, after the product is loaded and the bag is sealed, the opening of the carton is closed, thus constituting the final product.

FIG. 1 schematically illustrates all the stages of the production of the bag-in-carton starting from the carton blank 200 and ending at the finished product 200G.

Figure 3:
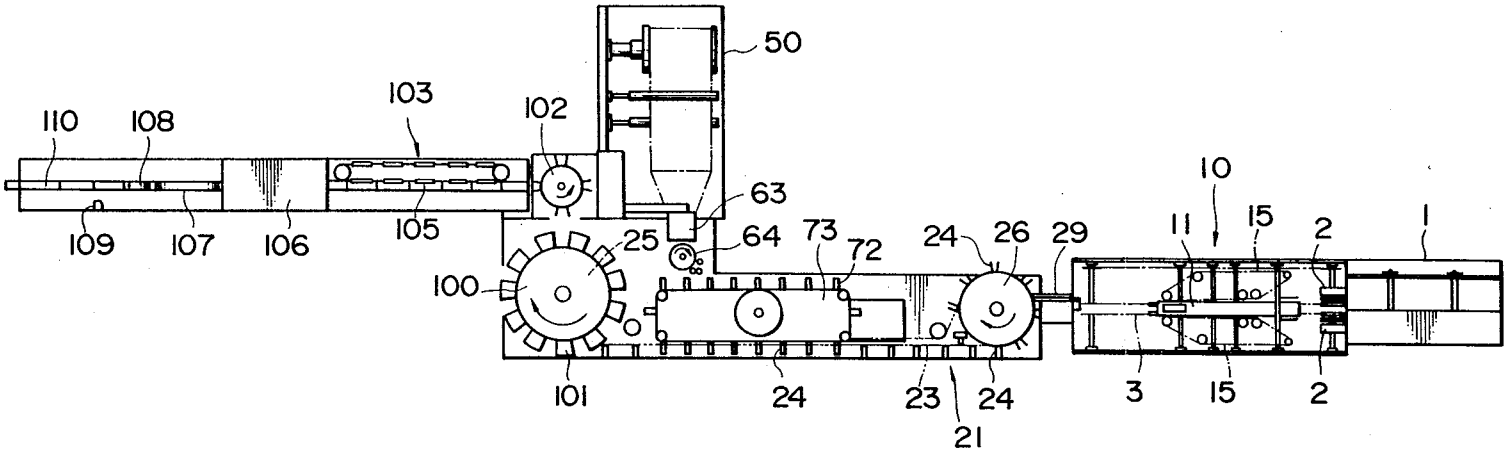
FIG. 3 is a plan view of the apparatus of FIG. 2.

Referring now to FIGS. 2 and 3, it will be seen that the apparatus for producing the bags wrapped in cartons according to the invention comprises a carton magazine 1 followed by a carton former 10 to which a carton making machine 21 is connected. Reference numeral 50 designates a bag making apparatus which is connected to a discharging conveyor 103. A heat sealer 106 is positioned at the top of discharging conveyor 103. The remaining structural components shown in FIGS. 2 and 3 will be described below.

Each step of the method in conjunction with the respective unit of the apparatus according to the invention will be now described in detail.

CARTON MAGAZINE AND CARTON FORMER

Figure 5:
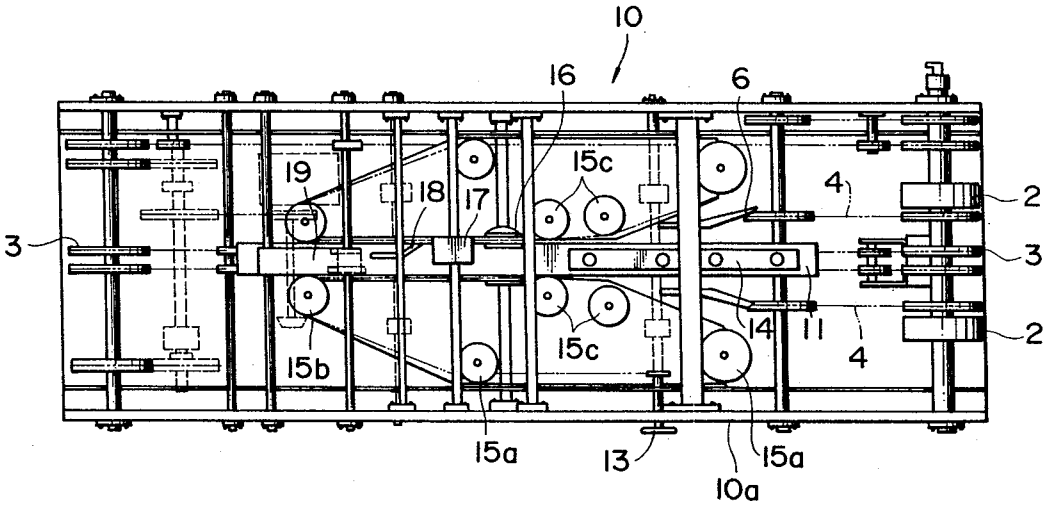
FIG. 5 is a plan view of the carton forming apparatus.
Figure 6:
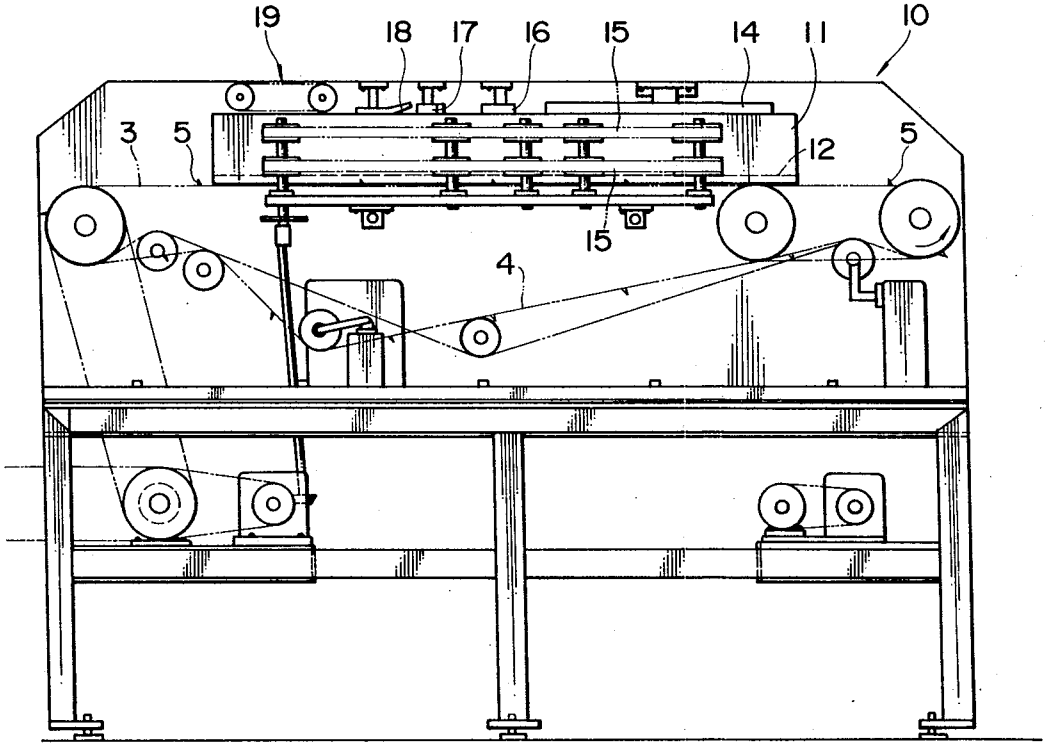
FIG. 6 is a front elevational view of the apparatus of FIG. 5.
Figure 7:
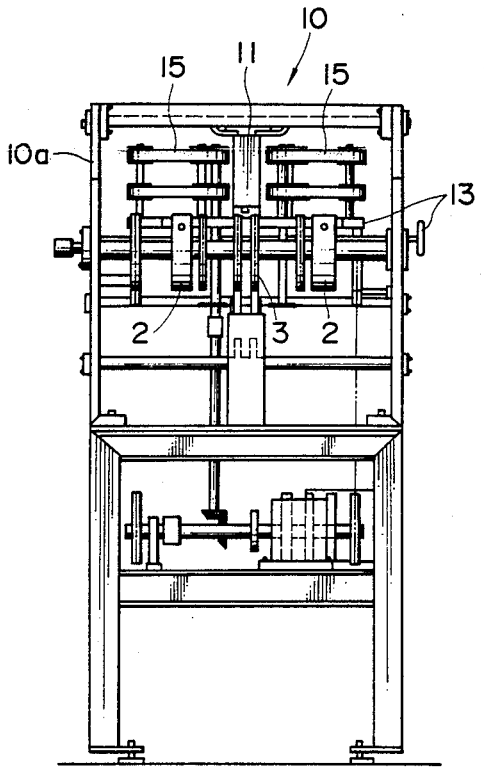
FIG. 7 is a side elevational view of the apparatus of FIG. 5.
Figure 8A:
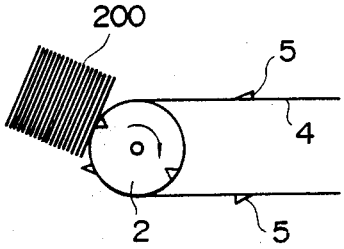
FIGS. 8A and 8B show the steps of supplying a blank by pick-up rollers.
Figure 8B:
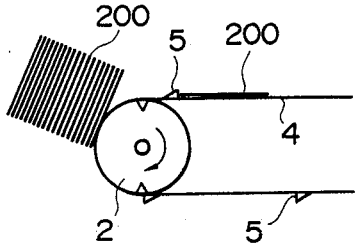

A number of flat blanks 200 are piled and stocked in a carton magazine 1 shown in FIG. 1. As shown in FIGS. 5 to 7, a pair of vacuum pick-up rolls 2 of the carton former 10 are disposed immediately in front of the carton magazine 1 to supply the flat blank 200 onto a carton conveyor 3 of the carton former. The carton conveyor 3 continuously conveys the flat blank 200, while supporting it horizontally, toward a carton forming block 11 which will be described herein below. As also seen from FIGS. 8A and 8B conveyor 3 includes a number of pushers 5 attached on at least one endless chain 4 with a fixed distance between each other. The pick-up rolls 2 pick up and transmit the flat blank 200 from the carton magazine 1 onto the conveyor 3; the conveyor 3 hooks on the rear portion of the flat blank 200; each pusher 5 pushes the blank 200 forward without bending it. As this flat blank 200 is continuously conveyed, it is supplied to a carton former 10.

Figure 9A:
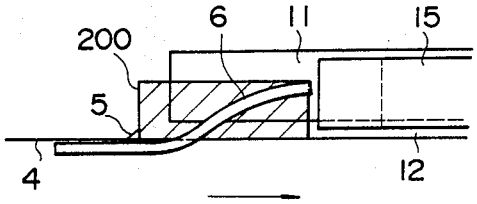
FIGS. 9A and 9B show the steps of forming the blank into a carton by the forming guide rails and the carton forming block.
Figure 9B:
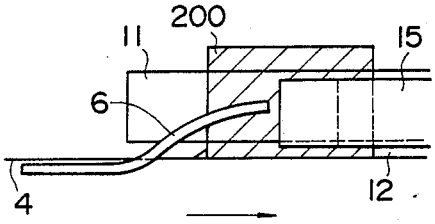

As further seen from FIG. 5, downstream of the pick-up rolls 2 are positioned a pair of carton forming guide rails 6, which have a slightly wider space between them than the side panel 203 of the blank 200. Guide rails 6 are arranged symmetrically. The front portions of the forming guide rails 6 are at the same level as the plane of the path of conveyor 3. They are gradually raised from the middle portions, and formed in such a way that they are twisted by approximately 90° pointing inward of the direction of the blank advancement. Also, the space between the rear portions of forming guide rails 6 are narrower than that of the front portions thereof. Guide rails 6 are also shown in detail in FIGS. 9A and 9B. When forming the flat blank 200, a carton forming block 11, which serves for supporting the blank from the inside, is disposed between the forming guide rails 6 (FIG. 5). The flat blank 200, which is supplied onto the forming guide rails 6 by the pushers 5 of chain 4, has its side panel 203, held down by the carton forming block 11, and is folded into roughly a "U" shape due to folding lines between the front panel 201, the rear panel 202 and the side panel 203 while panels 201 and 202 are kept open by the forming guide rails 6 at their both sides.

Figure 10:
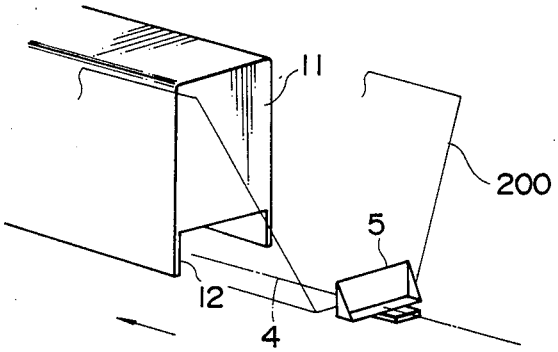
FIG. 10 is a perspective view showing the relation between the pushers disposed on a chain and an incision disposed on the block for forming the bottom side of the carton.

With reference to FIG. 6 it is seen that the carton forming block 11 extends horizontally in the direction of the blank advancement, and has a square or rectangular cross-section whose size corresponds to the carton's inside measurement. The carton forming block 11 is suspended on a bag former support 14 which is fixed on a frame 10*a* of the carton former 10 (FIG. 5). The carton forming block 11 is arranged in such a way that it is both exchangeable and removable from the support 14, depending on the carton size. As shown in FIGS. 6 and 10, an incision 12 is formed on the bottom surface of the carton forming block 11 to allow the pusher 5 on the chain 4 to pass.

FIGS. 5 and 7 show that at both sides of the carton forming block 11, a pair of side forming belts 15 are disposed to cause the front panel 201 and the rear panel 202 of the blank 200 to touch the sides of said forming block. Reference numeral 13 denotes a rack with an adjustment handle to adjust a gap between the side forming belts 15. These side forming belts 15 are guided by a group of rollers 15*c*, 15*d*, etc. so that they contact both of the longer sides of the carton forming block 11, and are driven and rotated by pulleys 15*a* and 15*b* synchronously with the chain 4. Because of this, the front panel 201 and the rear panel 202 of the blank 200 are folded at right angles by the pressure applied by the side forming belts 15 so that the panels touch both sides of the carton forming block 11. At the same time, these front and rear panels are acted upon by a forward driving force due to friction between them and the forming belts 15 at both sides. Also, the side panel 203 is conveyed forward by one of the pushers 5 disposed on the chain 4 from under the carton forming block 11. Thus, the blank 200 is conveyed forward in a smooth and stable condition without being bent or made to wobble by the friction resistance between the blank and the forming block 11. In FIGS. 5 and 6, reference numeral 16 indicates a folding guide rail for the gluing flap 205. Guide rail 16 is extended towards the top of the middle portion of the forming block 11 and is attached to the frame 10*a*. Reference numeral 17 designates a hot molten glue spraying gun attached to the frame 10*a* and disposed downstream of the guide rail 16; 18 is a folding guide rail for the side panel 204 disposed downstream of the spraying gun 17, and 19 is a pressure-sticking roller disposed downstream of the guide rail 18.

In operation, first the gluing flap 205 is folded inward at right angles by guide rail 16, then the side panel 204 is folded at right angles and bonded to the gluing flap 205 by the glue spraying gun 17, guide rail 18 and roller 19. Consequently, with the corner portions of the four panels 201 to 204 folded at right angles with equal strength, the flat blank 200 is folded into a square-tubular or parallelepiped shape precisely, thus becoming a half-finished product. During this process, the blank 200 is continuously moved by the action of pushers 5 and forming belts 15, and reaches the discharging end of the carton conveyor 3.

Thereby the blank 200 is shaped into the carton 200B (FIG. 1), which carton is a half-finished product obtained at the discharging end of the conveyor 3. This half-finished product is made to stand upright from lying on its side and is dropped into the carton making machine 21 positioned downstream of the carton former 10.

CARTON MAKING MACHINE

Figure 11:
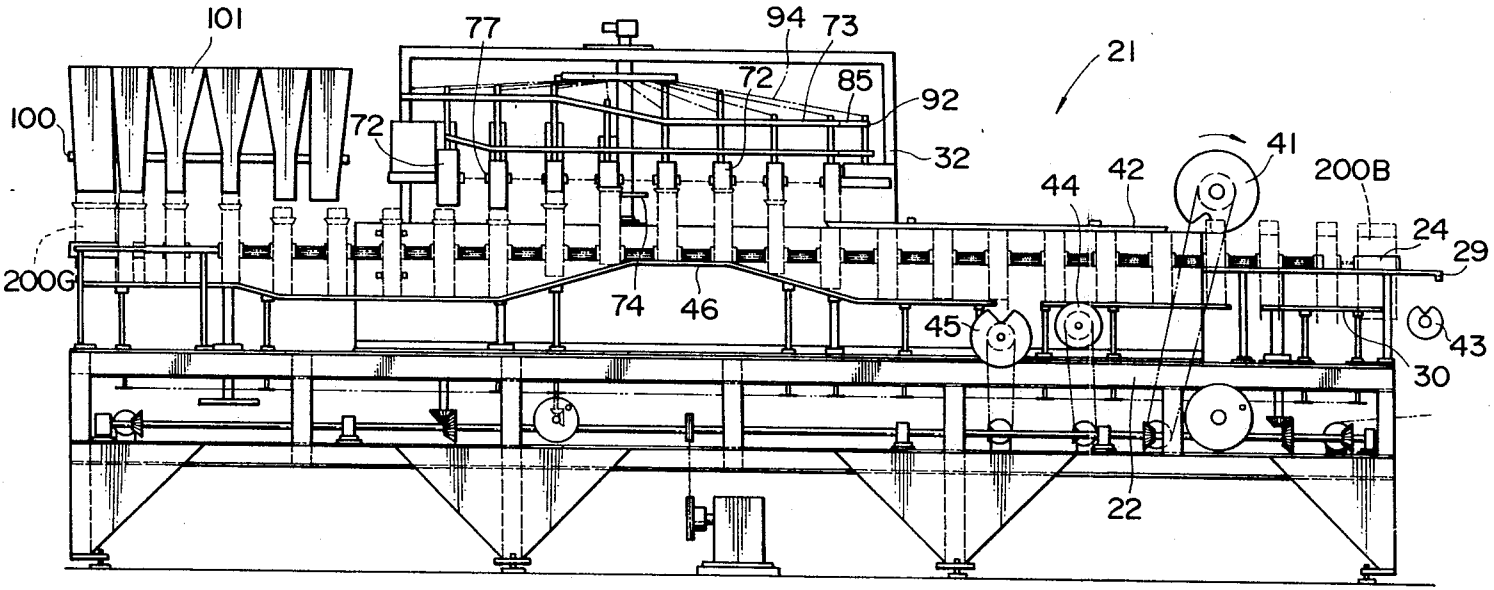
FIG. 11 is a front elevational view of a carton making machine.
Figure 14:
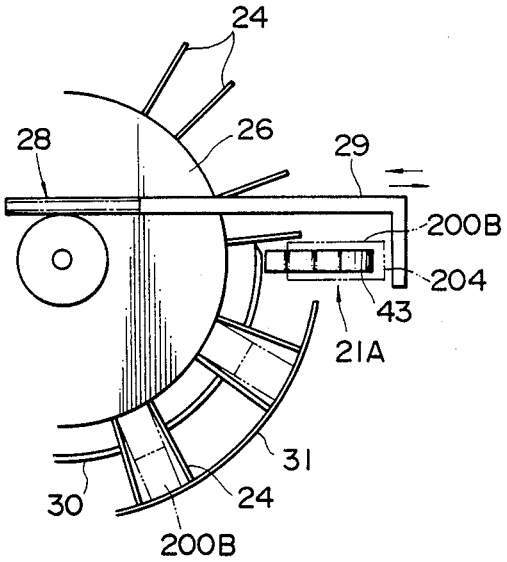
FIG. 14 is a plan view of the parts shown in FIG. 13.

As shown in FIGS. 11 and 14, the carton making machine 21 includes an endless chain 23, which has fingers 24 and rotates horizontally on a base 22. This endless chain 23 with fingers 24 is stretched between a large head wheel 25 and a tail driving wheel 26, and is combined with a group of guiding rollers 27 so that the chain passes on a given path.

The endless chain 23 has, along its length, a number of fingers 24, which are paired and open sideways, and spaced a fixed distance from each other. Also this chain 23 hooks the carton 200B discharged from the conveyor 3 of the carton former 10 by a drawing arm 29 at a carton receiving station 21A (FIG. 14) of the machine, and draws it inside a pair of the fingers 24 to convey it continuously along the chain 23.

Figure 12:
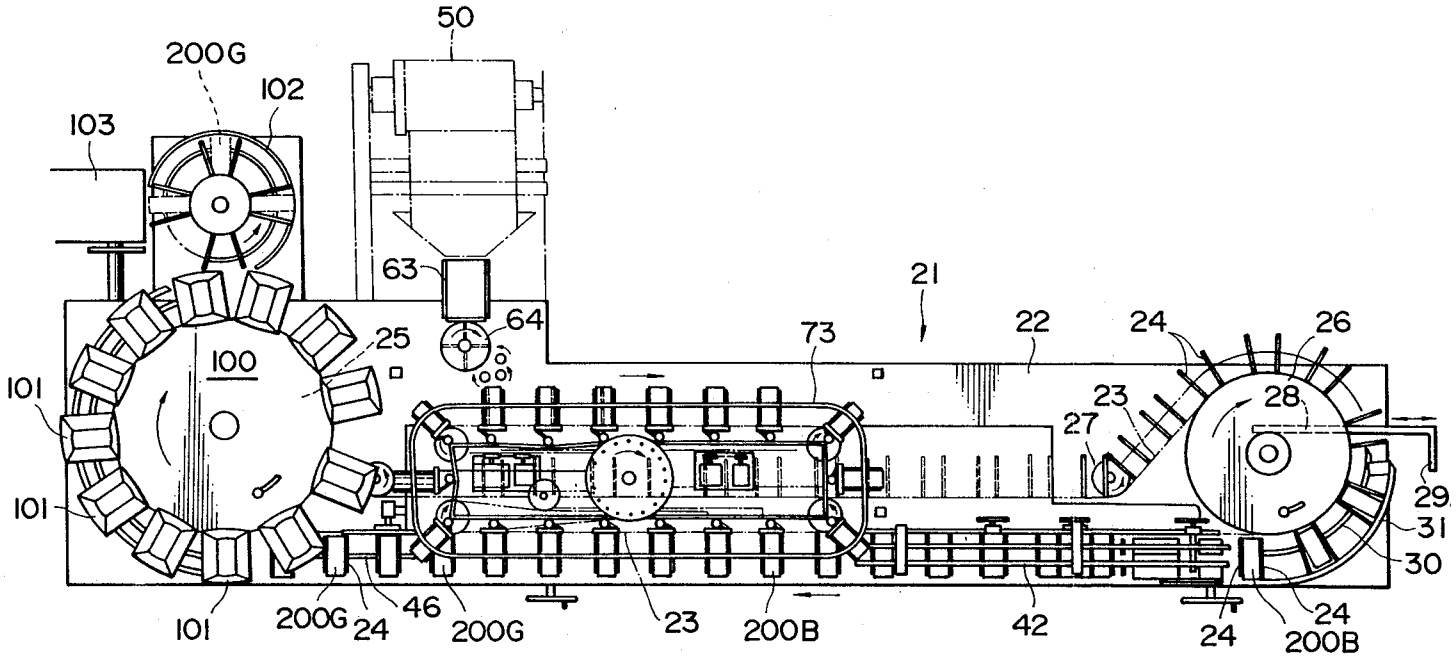
FIG. 12 is a plan view of the machine of FIG. 11.

The carton receiving station 21A is disposed at the outer rim of the tail wheel 26. When the chain 23 passes the rim of the tail wheel 26, a pair of the fingers 24 attached to said chain is given the degree of opening corresponding to the rate of bending of the tail wheel 26. Consequently, as shown in FIG. 12, the tips of the fingers 24 open outward. The front panel 201 and the rear panel 202 of the carton are drawn inside these outwardly open fingers 24 so that their panels run parallel to the fingers 24. Since the chain 23 with fingers 24 curve along the tail wheel 26, the carton 200B is turned horizontally by 90° as observed from above. Therefore, the carton 200B has its side panels 203 and 204 arranged in such a way that they run parallel to the direction of carton advancement. Thereafter, the carton 200B is conveyed with its side panels running parallel to the direction of carton advancement by the chain 23 at a fixed pitch, while the front panel 201 and rear panel 202 of carton 200B remain pinched frictionally between the pair of the fingers 24.

The drawing arm 29 is located below the discharging end of the conveyor 3. As further shown in FIG. 14, a rack and pinion mechanism 28, whose operation is in synchronism with the receiving of the carton 200B, is linked to this drawing arm. By moving the drawing arm 29 backward and forward horizontally using this rack and pinion mechanism 28, the carton 200B is transferred between the pair of the fingers 24 from the carton receiving station 21A.

As further seen from FIGS. 11–14, 30 is a bottom guide which prevents the carton 200B between the fingers from falling at the carton receiving station 21A, 31 is a side guide which prevents the carton 200B from springing out by centrifugal force when chain 23 rotates; 41 is a rotary cam operated top flap folding kicker which is disposed above the endless chain 23 and downstream of the carton receiving station 21A; and 42 is a top flap folding guide rail disposed downstream of the kicker 41. Further, 43 is a rotary cam operated kicker adapted to fold inwardly the bottom flap on the carton's rear side located below the drawing arm 29. A hot molten glue applicator 44 is disposed ahead of this folding kicker 43, and a rotary cam operated bottom flap folding kicker 45 is disposed on its downstream side. 46 is a bottom guide rail disposed downstream of the bottom flap folding kicker 45. This bottom guide rail 46 is inclined upwardly in the direction of carton advancement, and is structured so that carton 200B is conveyed while lifted to a given height. All of these structural components are installed on the base 22 or frame 32.

Figure 13:
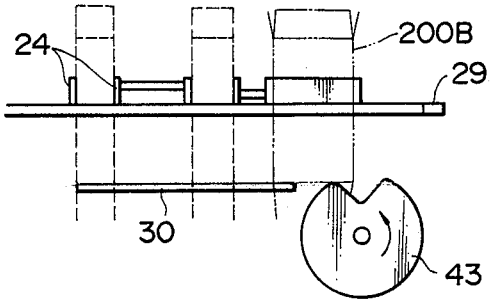
FIG. 13 is a side elevational view showing a part of the carton making machine with a drawing arm, fingers and a bottom flat folding kicker in relation with the carton being produced.

In operation, the carton 200B pinched between two adjacent fingers 24 first has its front top outer flap **206*a* pushed open outward by the folding kicker 41 before the carton reaches the bottom guide rail 46. Then the rest of the top flaps 207*a*, 208*a* and 209*a* are pushed open outward by the folding guide rail 42. Meanwhile on the bottom flap side, as shown in FIGS. 13 and 14, the rear inner flap 209*b* of the carton is folded inward by the folding kicker 43 as the carton is drawn inside the fingers 24 by the drawing arm 29. Then the front inner flap 208*b* is folded inward by the bottom guide 30. Then, after hot molten glue is applied to the rear bottom outer flap 207*b* by the applicator 44, this bottom outer flap is folded inward by the kicker 45. Then the front bottom outer flap 206*b* is folded onto the rear bottom outer flap 207*b* by the bottom guide rail 46, which finishes the bonding of the carton bottom. Hereafter carton 200B is conveyed along the bottom guide rail 46 and supplied to the apparatus which automatically loads into the carton a bag M which is produced by the bag making apparatus 50**.

BAG MAKING APPARATUS

Figure 15:
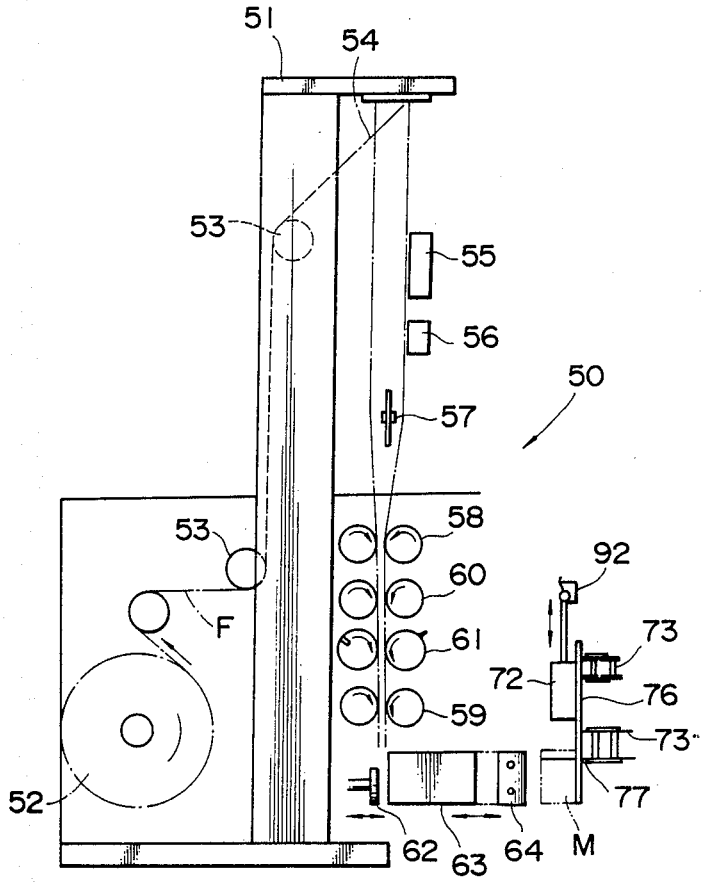
FIG. 15 is a side elevational view of a bag making apparatus.

FIG. 15 is a side elevational view showing the details of the bag making apparatus 50. In this figure, numeral 51 indicates a frame; numeral 52 indicates a roll of flat film F which is the bag material and installed on the frame; numeral 53 indicates a group of film guide rollers; numeral 54 indicates a tube forming block; numeral 55 indicates a heat sealer or back-bonding sheet roller; numeral 56 indicates a cooling bar; numeral 57 indicates a part of gusset forming rollers; numerals 58 and 59 indicate forward travel rollers; numeral 60 indicates a bottom heat sealer; and numeral 61 indicates a cutter. After the flat film F is passed through a group of guide rollers 53, it is wound round the tube forming block 54. Then its side portion is heat-sealed by the heat sealer 55 to form a tube shape. Then the tube-shaped product is passed between a pair of the gusset forming rollers 57 and flattened with its tube shape intact. The forward travel rollers 58 and 59 continuously convey the tube-shaped product by the amount equal to the bag length, and the bottom heat sealer 60 heat-seals the tube-shaped product while the product is moving due to the continuous advance action. While this heat-sealing is conducted, the portion immediately under the preceding bottom seal section is cut by the rotary cutter 61. A single gusset bag M which has been cut off is supplied to a bag magazine 63 by a pushing-in element 62. The bag M is then supplied to a bag former 72 via a bag opening and closing apparatus 71 shown in FIGS. 16 and 17 and described below by a pick-up roller 64 which contains a vacuum pad.

BAG OPENING AND CLOSING APPARATUS AND BAG FORMER

Figure 16:
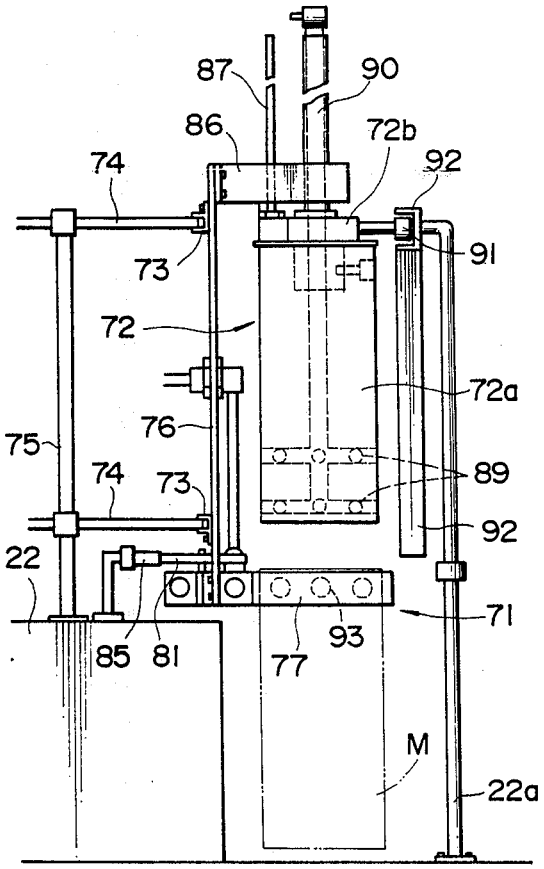
FIG. 16 is a front elevational view of the part of a bag opening and closing apparatus of FIG. 15.
Figure 17:
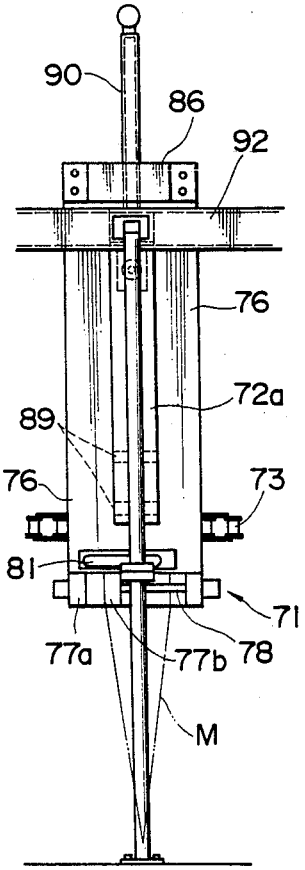
FIG. 17 is a side elevational view of the apparatus of FIG. 16.
Figure 18:
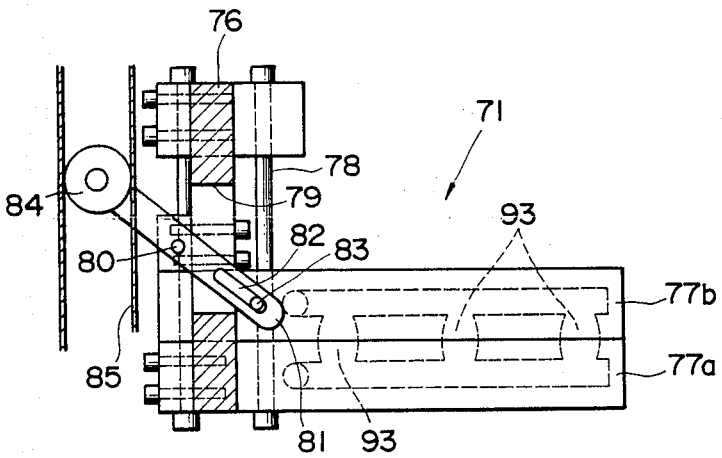
FIG. 18 is a plan view of a mechanism for opening and closing a bag support.
Figure 19:
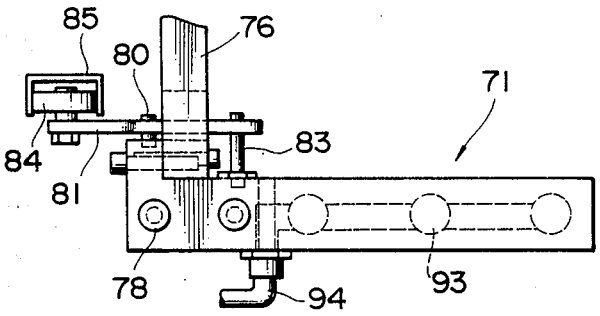
FIG. 19 is a front elevational view of the mechanism of FIG. 18.

As illustrated in FIGS. 16–20, the bag opening and closing apparatus 71 is attached to a pair of conveyor chains 73 which are driven in synchronism with the endless chain 23 in the carton making machine 21. In FIG. 16, 74 are driving wheels of the conveyor chain 73, which are supported by a driving shaft 75 supported on the base 22 of the carton making machine 21 in such a way that it rotates horizontally. The running path of the conveyor chains 73 is set by pulleys and guide rollers, as shown in FIG. 12, so that a part of the chain runs parallel to the bottom guide rail 46. 76 is a chain attachment installed on the pair of the conveyor chains 73 with a distance between the chains fixed, and 77 is a bag supporter installed on the bottom portion of this attachment. Bag supporter 77 comprises a fixed bar **77*a* which is fixedly installed on the bottom portion of the attachment, and a movable bar 77*b*, as shown in FIGS. 17 and 18. The movable bar 77*b* is installed so that it can engage or disengage from the fixed bar 77*a*, by means of a pair of sliding rods 78** installed horizontally on the attachment 76. As shown in FIGS. 18 and 19, an arm 81, which is supported on the chain attachment 76 by a pin 80 so that it can swing, is disposed in a space 79 provided in the middle portion of the attachment 76. A slot 82 is formed at one end of arm 81, and a pin 83, which is installed on top of the movable bar 77*b*, is inserted into this slot. Also, a roller operated cam follower 84 is supported on the other end of the arm 81. This cam follower 84 rolls while controlled by a guide rail 85 running parallel to the conveyor chains 73. When the cam follower 84 rolls by means of the pin 83 which is inserted into the slot 82, the arm 81 causes the movable bar 77*b* and the fixed bar 77*a* to engage or disengage from each other with the pin 80 as a fulcrum of the swing. Also, vacuum pads 93 are disposed on the facing sides of the fixed bar 77*a* and movable bar 77*b*. Further a flexible hose 94, which is connected to a vacuum pump, is connected to these pads 93.

Figure 20:
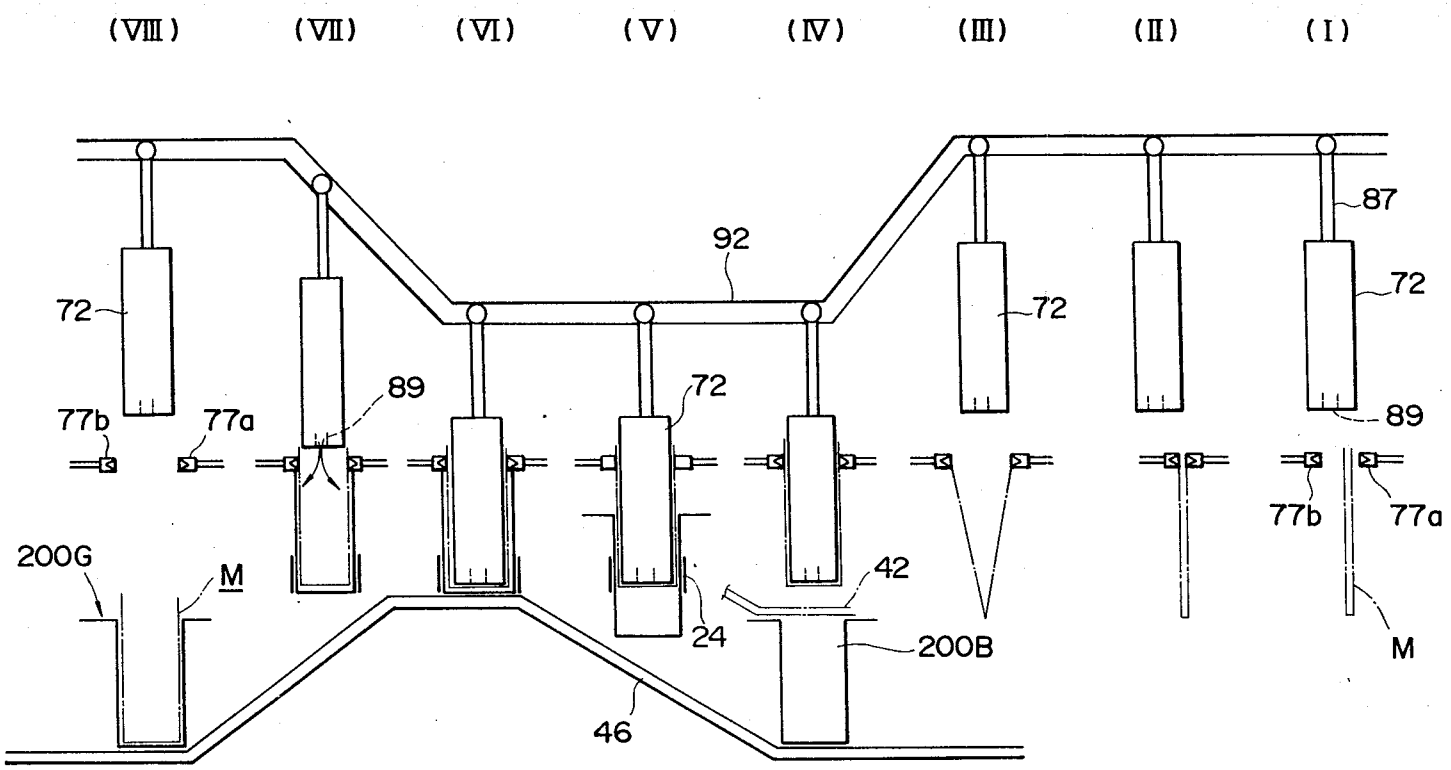
FIG. 20 is a diagram showing the movement of the mechanism for bag opening and closing and the bag former.

As shown in FIG. 20, the fixed bar 77*a* and the movable bar 77*b* are separated from each other at the beginning of the movement, and they close to contact the bag M as the bag is supplied from the bag magazine 63, then the sucking action starts. Subsequently the movable bar 77*b* is moved away from the fixed bar 77*a* while the bag M is held by suction, and the bag former 72 is inserted into the bag M while this state is retained. Also, the movement of the bag former 72 and the bag supporter 77 which comprises the fixed bar 77*a* and movable bar 77*b* are made to synchronize with the supplying of the carton 200B from the carton making machine 21 and the supplying of the bag M from the bag magazine 63.

In addition, a supporter 86 (FIGS. 16, 17) to support the bag former 72 in such a way that it can move up and down is disposed on the top portion of the chain attachment 76. A suspension rod 87 is supported so that it can move up or down against the bag supporter 86. The bag former 72 is fixed to the bottom portion of suspension rod 87 by means of an installation head 72*b*. The bag former 72 has a bag forming mandrel 72*a* whose size corresponds to the inside measurement of the bag M. This mandrel is of a square or rectangular cross-section. Mandrel 72*a* has one or a number of air blowing nozzles 89 in its bottom portion. An air hose 90 to introduce high-pressure air is connected with air blowing nozzles 89 and disposed on the top end of the mandrel 72*a*. A connecting means for air flow is formed inside the mandrel 72*a* and connecting blowing nozzle 89 with means for supplying high-pressure air. On the side of the installation head 72*b*, a roller operated cam follower 91 is disposed to move up or down this mandrel 72 together with the said head. This cam follower 91 is structured to run along a guiding rail 92 which is supported by brackets on the base 22. The guiding rail 92, as shown in FIG. 20, is shaped with bends to have upward and downward inclinations so that it can move the bag former 72 down when the mouth of bag M is opened by the bag supporter 77 and it can move the bag former 72 up when the former 72 is pulled out of the bag M.

With reference to FIG. 20, now the explanation is given on the bag forming process by the bag former 72 and the process of loading the bag M into the carton 200B. First, when the bag M is supplied to the bag supporter 77, the bag former 72 is positioned above the bag M so that it does not interfere with it (Stage I). At this point, bars 77*a* and 77*b* are separated from each other and the bag M is inserted between them. In the following process the fixed bar 77*a* and the movable bar 77*b* approach each other and, at the same time, the vacuum pads 93 start suction (Stage II). Then bars 77*a* and 77*b* are opened while the bag M is held by suction, and the bag mouth is opened (Stage III). Following this, the bag former 72 gradually moves down guided by the cam follower 91 and its guiding rail 92, and is pushed inside the bag M (Stage IV). Consequently, the bag M is wound around the exterior of the bag former 72 while being properly and exactly inflated to the bottom. After this forming process has been completed, the vacuum pads 93 stop suction. At this point, the carton 200B is lifted to a given height from under the bag former 72 guided by the bottom guide rail 46. At this point, the carton 200B is loaded from below onto the bag M with the bag former 72 inserted into it (Stage VI). After this loading process is completed, high-pressure air is blown out of the air blowing nozzles 89 disposed on the bag former 72 into the bag M (Stage VII). During this blowing of high-pressure air, the bag former 72 is lifted to a given height by the action of the cam follower 91 and the upward inclined rail 92, which causes the bag former 72 to separate from the bag M automatically. Consequently, the bag M and the carton 200B are placed on the bottom guide rail 46 in the state where they are closely assembled (Stage VIII). In FIG. 20, the bottom guide rail 46 is slightly inclined downward at the position where the bag former 72 is pulled out of the bag.

Thus, the bag-in-carton 200G, which is ready to receive the product to be packed, is completed. This bag-in-carton 200G is then supplied to the filling position 100 to be filled with the product to be packed, and the product to be packed is measured and filled at the filling position 100 as will be explained herein below. After filling the product, the process of sealing the bag opening and the process of closing the carton's top end are completed, which finishes all the product packing process.

As shown in FIGS. 11 and 12, the bag-in-carton 200G is supplied to a rotary measuring hopper 101 by the bottom guide rail 46 and fingers 24 of the chain 23.

Figure 21:
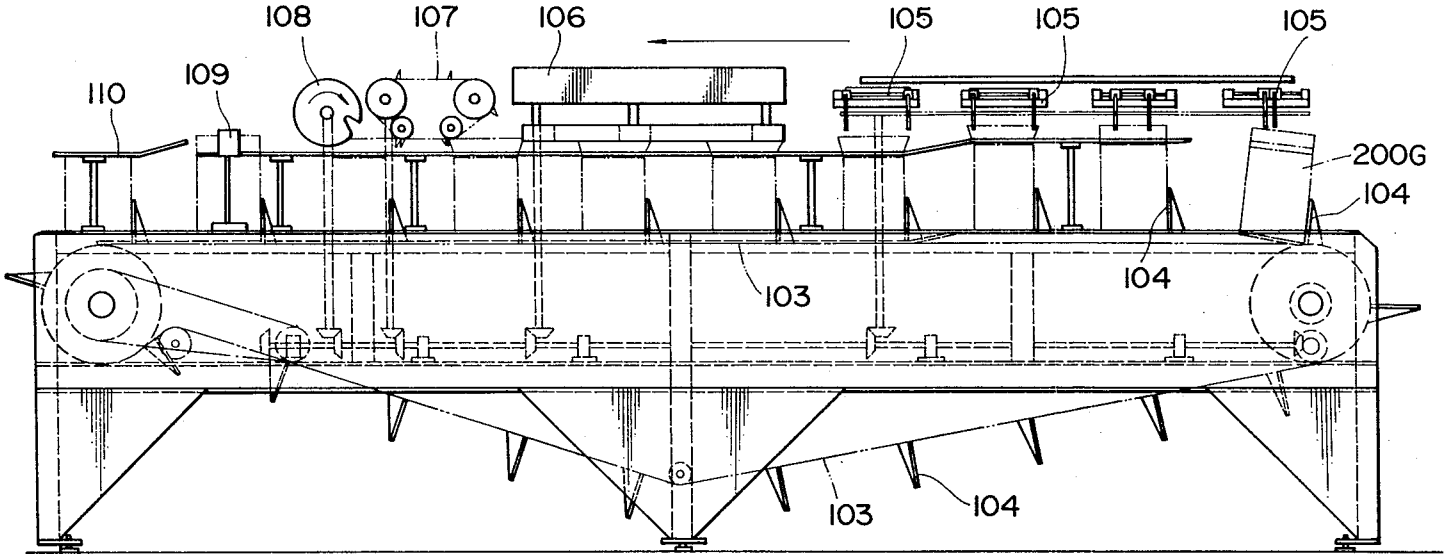
FIG. 21 is a front elevational view of a discharging conveyor.

A fixed amount of the product to be packed is filled into the bag-in-carton 200G from the measuring hopper 101. Then the bag-in-carton 200G, which is filled with the product to be packed, is supplied to the discharging conveyor 103 mentioned above in connection with FIGS. 2 and 3 by a transferring apparatus 102. The discharging conveyor 103 is driven in synchronism with the carton making machine 21. As shown in FIG. 21, the discharging conveyor 103 has a number of pushers 104 provided on an endless belt or chain with a fixed distance between each other. The bag-in-carton 200G, which is pushed out of the transferring apparatus 102, is continuously conveyed by the pushers 104. In this conveying process, bag opening and closing fingers 105, which are disposed above the discharging conveyor 103, are inserted into the top end to tightly stretch the mouth of the bag. Subsequently the mouth of the bag is heat-sealed by a heat sealer 106. After heat-sealing, the top end of each bag is folded inside of the carton 200G by a bag pushing-in apparatus 107. Then the inner flap 208*a* of each carton is folded inward by a top flap folding wheel 108. Then, after a hot molten glue is applied to the outer flap 106*a* of the carton by a hot molten glue spraying gun 109, the outer flap 207*a* is folded inward by a top guide rail 110. Then the other outer flap 206*a* is folded onto the outer flap 207*a*, and with this done the bag-in-carton 200G is sealed.

As explained above, the present invention makes it possible to produce a bag-in-carton automatically, economically and at high speed using a process of continuous motion without a forming mandrel making intermittent movements, as well as making the carton's side panels run parallel to the direction of carton advancement in order to make the advancing pitch of the material smaller. Also, as no limit is set to the carton and bag materials to be used, the forming of both materials can be precise and quick. Moreover, the bag and the carton can be assembled efficiently after the forming. With this apparatus, the mechanism to be used can be simply structured. Also, when forming the carton into a parallelepiped shape, it is possible to fold all of the corner portions of the four panels exactly at right angles with equal strength. Therefore, a carton which does not easily get out of shape is obtained. Also, this invention makes it possible to form the carton and the bag quickly as well as with folding precision, and in particular makes it possible to inflate precisely and exactly the bottom portion of the bag which is difficult to inflate. Further the bag forming mandrel can be easily pulled out without causing the bag forming mandrel and the bag to touch each other. Also, the sizes of the carton and the bag can be changed easily in a short time.

It will be understood that each of the elements described above, or two or more together, may also find a useful application in other types of methods and devices for producing bags wrapped in cartons differing from the types described above.

While the invention has been illustrated and described as embodied in a method and apparatus for making bags wrapped in cartons, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for producing a bag-in-carton, comprising the steps of:

(a) providing a flat carton blank having folding lines;
(b) feeding said flat carton blank to conveyor means;
(c) folding said blank along the folding lines thereof to form a square tubular-shaped carton which has side panels and a bottom portion and lies on one side on said conveyor means which supports and conveys said carton horizontally;
(d) raising said square tubular-shaped carton lying on the side panel thereof vertically and transferring it to further conveyor means while turning the carton so that the carton runs on said further conveyor means with the side panels thereof parallel to said further conveyor means;
(e) bonding the bottom portion of said square tubular shaped carton while it is being conveyed;
(f) providing a flattened bag;
(g) feeding the flattened bag to said further conveyor means with a top portion thereof being unsealed; and
(h) inserting said bag into the square tubular shaped carton, after inflating said bag to a square-tubular shape from above said square tubular shaped carton conveyed.

2. A method for producing a bag-in-carton, comprising the steps of:

(a) providing a flat carton blank having folding lines;
(b) providing a first conveyor means;
(c) feeding said flat carton blank to said first conveyor means;
(d) folding said blank along the folding lines thereof on said first conveyor means to form a square tubular-shaped carton which has side panels and a bottom portion and lies on one side on said first conveyor means which supports and conveys said carton horizontally;
(e) raising said square tubular-shaped carton lying on the side panel thereof vertically and transferring it to a second conveyor means while turning the carton so that the carton runs on said second conveyor means with the side panels thereof parallel to said further conveyor means;
(f) bonding the bottom portion of said square tubular shaped carton while it is being conveyed;
(g) providing a flattened bag having a filling aperture;
(h) feeding the flattened bag to said second conveyor means with a top portion thereof being unsealed;
(i) inserting said bag into the square tubular shaped carton, after inflating said bag to a square-tubular shape from above said square tubular shaped carton conveyed;
(j) measuring and filling product to be packed in a bag-in-carton into said bag; and
(k) successively sealing the filling aperture of said bag and an open portion of said square-tubular shaped carton.

3. The method according to claim 1, wherein the step of folding said blank along the folding lines to form a square tubular shaped carton further comprises holding down one of the side panels of said carton by a carton forming block having a square cross section, while successively advancing said flat blank, raising front and rear panels of said carton by forming guide rails and forming belts provided at both sides of said forming block, applying glue to a gluing flap of said blank, and bonding the gluing flap to a corresponding edge of the blank after applying glue.

4. The method according to claim 1, wherein said step of inserting said bag into the square-tubular shaped carton comprises pinching a top portion of said bag at both sides thereof with a pair of holding bars while holding the bag by vacuum pads, opening a mouth aperture of said bag by moving the pair of holding bars away from each other.

5. The method according to claim 1, wherein said step of inserting said bag into the square tubular shaped carton comprises inserting a bag forming mandrel which has a square cross-section into the bag from above through an aperture of said bag to produce a square shape of said bag and pulling out said mandrel upwardly of said bag.

6. The method according to claim 5, wherein the step of pulling out said mandrel upwardly includes blowing air out from the mandrel into the bag during said pulling out of said mandrel.

7. The method according to claim 2, wherein the step of folding said blank along the folding lines to form a square tubular shaped carton further comprises holding down one of the side panels of said carton by a carton forming block having a square cross-section, while advancing said flat blank, raising front and rear panels of said carton by forming guide rails and forming belts provided both sides of said forming block, applying glue to a gluing flap of said blank, and bonding the gluing flap to a corresponding edge of the blank after applying glue.

8. The method according to claim 2, wherein said step of inserting said bag into the square tubular-shaped carton comprises pinching a top portion of said bag at both sides thereof with a pair of holding bars while holding the bag by vacuum pads and opening a mouth aperture of said bag by moving the pair of holding apparatus away from each other.

9. The method according to claim 2, wherein said step of inserting said bag into the square tubular shaped carton comprises inserting a bag forming mandrel which has a square cross-section into the bag from above through an aperture of said bag to produce a square shape of said bag and pulling out said mandrel upwardly of said bag.

10. Apparatus for producing a bag-in-carton, comprising:

(a) a carton magazine to pile and stock a number of flat blanks each having folding lines;

(b) means for successively and horizontally feeding each blank from said magazine onto a conveyor means;

(c) means for folding said blank along the folding lines thereof to form a square tubular-shaped carton having front and rear panels, side panels and a bottom portion while said blank lies on a side thereof on said conveyor means;

(d) means for raising said square tubular-shaped carton lying on its side vertically and transferring it to further conveyor means while turning the carton so that the carton runs on said further conveyor means with the side panels thereof parallel to said further conveyor means;

(e) means for automatically bonding the bottom portion of said square tubular shaped carton while it is conveyed;

(f) a magazine to stock a number of flattened bags with a top portion of each bag being unsealed;

(g) means for successively supplying each bag from said magazine onto said further conveyor means; and (h) means for forming said bag into a square-tubular shape above the square tubular shaped carton conveyed and inserting said bag into the square tubular-shaped carton sequently.

11. Apparatus for producing a bag-in-carton, comprising:

(a) a carton magazine to pile and stock a number of flat blanks each having folding lines;

(b) means for successively and horizontally feeding each blank from said magazine onto conveyor means;

(c) means for folding said blank along the folding lines thereof to form a square tubular-shaped carton having side panels, front and rear panels and a bottom portion while said blank lies on a side thereof on said conveyor means;

(d) means for raising said square tubular-shaped carton lying on its side panel vertically and transferring it to further conveyor means while turning the carton so that the carton runs on said further conveyor means with the side panels thereof parallel to said further conveyor means;

(e) means for automatically bonding the bottom portion of said square-tubular shaped carton while it is conveyed;

(f) a magazine to stock a number of flattened bags with a top portion of each bag being unsealed;

(g) means for successively supplying each bag from said magazine onto said further conveyor means; and (h) means for forming said bag into a square-tubular shape above the square tubular shaped carton being conveyed to produce a bag having a filling aperture and inserting said bag into the square tubular-shaped carton sequently;

(i) means for successively measuring and filling product to be packed into said bag;

(j) means for successively sealing the filling aperture of said bag; and (k) means for automatically closing an open end of the square tubular-shaped carton containing said bag therein while said carton is conveyed.

12. The apparatus according to claim 10, wherein said means for feeding the flat blanks from the magazine includes a first conveyor means, said first conveyor means including pushers and an endless conveyor to which said pushers are attached at predetermined intervals therebetween, pick-up rolls disposed between said conveyor and said magazine and having means for absorbing the flat blank on the magazine to transfer it to the carton conveyor.

13. The apparatus according to claim 10, wherein said means for folding said blank to form a square-tubular shaped carton includes:

(a) a pair of forming rails extending in a longitudinal direction of said conveyor means to fold the front and rear panels of said flat blank vertically;

(b) a carton forming block disposed between said forming guide rails extending in a direction of advancing of said blank, said carton forming block having a square cross-section of a size corresponding to that of the carton formed;

(c) a pair of forming belts disposed at both sides of said block and running to support the front and rear panels of said carton pressed to the both sides of said block;

(d) means for applying glue to a gluing flap provided on said blank, said glue applying means being disposed at an upper side of said forming block; and (e) means for bonding the gluing flap with the applied glue to a corresponding edge of said carton.

14. The apparatus according to claim 13, wherein said forming guide rails have surfaces horizontally extending at the same level as a plane of said conveyor means, said surfaces being twisted inwardly and gradually raised up.

15. The apparatus according to claim 13, wherein said forming belts have means for adjusting a gap between the belts.

16. The apparatus according to claim 13, wherein said carton forming block has an incision in a longitudinal direction of the bottom surface thereof.

17. The apparatus according to claim 10, wherein said means for forming the bag into a square-tubular shape includes:

(a) a plurality of means to support the bag, disposed at both sides of the aperture of the bag and being movable between a first position in which said means engage the bag and a second position in which said means disengage from the bag; and (b) a bag forming mandrel disposed in correspondence to said bag support means and vertically moved along said bag support means and having a square cross-section of the size corresponding to that of the bag.

18. The apparatus according to claim 17, wherein said means for forming the bag into a square tubular shape includes:

(a) means for conveying said bag support means and said bag forming mandrel in synchronization with said square-tubular shaped carton being conveyed; and (b) a guiding means for moving said mandrel up and down.

19. The apparatus according to claim 18, wherein said bag forming mandrel includes:

(a) at least one air blowing nozzle formed in a bottom portion of said mandrel; and (b) a connecting means for air flow formed inside the mandrel and connecting said nozzle with means for supplying high-pressure air.

20. The apparatus according to claim 18, wherein said bag support means includes:

(a) a bar fixed to a driving chain by an attachment, an arm removably held to said bar and rotatably attached to said attachment, and a movable bar operated by a cam means and disposed on said arm; and (b) vacuum pads disposed on respective facing surfaces of said fixed bar and said movable bar and connected with a vacuum pump by an air hose.

21. The apparatus according to claim 10, wherein said further conveyor means includes:

(a) an endless chain with fingers for continuously conveying said square tubular shaped carton in a predetermined direction; and (b) conveyor means which has a bottom guide rail to guide the bottom portion of said square tubular shaped carton.

22. The apparatus according to claim 11, wherein said further conveyor means includes:

(a) an endless chain with fingers for continuously conveying said square tubular shaped carton in a predetermined direction; and (b) conveyor means which has a bottom guide rail to guide the bottom portion of said square tubular-shaped carton.

* * * * *